US011197536B2

(12) United States Patent
Pulfrey et al.

(10) Patent No.: US 11,197,536 B2
(45) Date of Patent: Dec. 14, 2021

(54) BACKCOMBING BRUSH

(71) Applicant: Tangle Teezer Limited, London (GB)

(72) Inventors: Shaun Pulfrey, London (GB); Cameron Bruce William Treeby, London (GB)

(73) Assignee: Tangle Teezer Limited, London (GB)

( * ) Notice: Subject to any disclaimer, the term of this patent is extended or adjusted under 35 U.S.C. 154(b) by 262 days.

(21) Appl. No.: 16/339,823

(22) PCT Filed: Oct. 11, 2017

(86) PCT No.: PCT/GB2017/053070

§ 371 (c)(1),
(2) Date: Apr. 5, 2019

(87) PCT Pub. No.: WO2018/069697

PCT Pub. Date: Apr. 19, 2018

(65) Prior Publication Data

US 2020/0046109 A1 Feb. 13, 2020

(30) Foreign Application Priority Data

Oct. 13, 2016 (GB) ..... 1617364

(51) Int. Cl.

| | |
|---|---|
| ***A46B 9/02*** | (2006.01) |
| ***A45D 24/04*** | (2006.01) |
| ***A46B 9/06*** | (2006.01) |
| ***A46D 1/00*** | (2006.01) |

(52) U.S. Cl.

CPC ..... *A46B 9/028* (2013.01); *A45D 24/04* (2013.01); *A46B 9/023* (2013.01); *A46B 9/06* (2013.01); *A46D 1/0238* (2013.01); *A46D 1/0284* (2013.01); *A46B 2200/104* (2013.01)

(58) Field of Classification Search

CPC ..... A45D 24/02; A45D 24/04; A46B 9/023; A46B 9/028

See application file for complete search history.

(56) References Cited

FOREIGN PATENT DOCUMENTS

| | | |
|---|---|---|
| CN | 203137396 | 8/2013 |
| CN | 204120444 | 1/2015 |
| EP | 0276969 | 3/1988 |
| EP | 3097817 | 11/2016 |
| GB | 2447692 | 9/2008 |

(Continued)

OTHER PUBLICATIONS

International Search Report dated Jan. 17, 2018 for International Application No. PCT/GB2017/053070 (3 pages).

(Continued)

*Primary Examiner* — Shay Karls
(74) *Attorney, Agent, or Firm* — Tarolli, Sundheim, Covell & Tummino LLP; John A. Yirga, Esq.

(57) ABSTRACT

A backcombing brush for backcombing hair includes an array of bristles 4. Each bristle extends from a base to a free end and two lengths of bristle are provided. Shorter bristles 4*a* and the bottom of longer bristles 4*b* carry out backcombing, whilst the longer bristles smooth hair, or untangle knots/tangles in the hair to reduce the level of backcombing. The long bristles have a relatively wide first portion 5, towards the base of the bristle, and a relatively narrow second portion 6, towards the free end of the bristle. The bristles are arranged such that bristles in one row neither extend between adjacent bristles in an adjacent row nor partially occlude the space between bristles in an adjacent row.

23 Claims, 7 Drawing Sheets

(56) References Cited

FOREIGN PATENT DOCUMENTS

| | | |
|---|---|---|
| JP | H10127344 | 5/1998 |
| WO | WO 2015/111138 | 7/2015 |
| WO | WO 2016/001658 | 1/2016 |
| WO | WO 2016/001665 | 1/2016 |

OTHER PUBLICATIONS

English translation of abstract of CN2014120444 dated Jan. 28, 2015 (1 page).
English translation of abstract of CN203137396 dated Aug. 21, 2013 (1 page).
English translation of JPH10127344 (2 pages).

BACKCOMBING BRUSH

CROSS REFERENCES TO RELATED APPLICATION

The present application is a 35 U.S.C. § 371 National Stage Patent Application claiming priority to International PCT Application Serial No. PCT/GB2017/053070 having an International filing date of Oct. 11, 2017 and that was published on Apr. 19, 2018 under international publication number WO 2018/069697, which claims priority to Great Britain Patent Application Ser. No. 1617364.3 that was filed on Oct. 13, 2016. This Application claims priority to and incorporates by reference the above-identified applications in their entireties for all purposes.

TECHNICAL FIELD OF THE INVENTION

The present invention relates to a backcombing brush.

BACKGROUND TO THE INVENTION

Backcombing brushes and backcombing combs are used to make hair appear thicker, or add volume or shape, so as to achieve hairstyles such as the distinctive beehive worn by the late Amy Winehouse.

Backcombing (sometimes more accurately called back-brushing where a brush is used, but referred to herein as backcombing) involves repeatedly brushing/combing sections of hair towards the scalp, causing some hair to tangle and/or knot up near the base to build body. After this backcombing step, the outer layer of back-combed hair is often brushed/combed, often with a different comb/brush to smooth and remove tangles at the surface and provide an attractive external appearance.

Certain brushes have been produced and proposed which are intended to aid in the backcombing process. These backcombing brushes typically have long, thin heads compared to ordinary brushes (e.g. no more than 2 cm wide and 5-10 cm long), they frequently have long thin handles that can be used to separate hair into sections to be backcombed.

Generally, the bristles on these conventional backcombing brushes are provided in bunches, with typically no more than three rows of bunches of bristles, with around 15-20 bunches in each row. The bristles are often natural, e.g. boar bristles, or sometimes nylon. Mixtures of boar and nylon bristles have also been used in the same brush.

Against that background, a backcombing brush is proposed in WO2016/001658 (shown in FIG. 20 thereof). That brush has four rows of bristles arranged individually, rather than in bunches. The bristles are each formed with first relatively wide portions towards their base and second relatively narrow portions extending to the tip. The relatively wide portions have an oval cross section, each arranged with its long axis transverse to the length of the brush, and the wide portion tapers abruptly to a circular cross section, from which the narrow portion (which has a circular cross section) extends. Hair is intended to be captured in the relatively narrow spaces between the wide portions of the bristles, enabling the brush to effectively grab and tease hair to generate body. The narrow portions can then be used to smooth the outer layer of hair.

Apart from brushes intended for backcombing, there are of course various other brushes available to carry out other specific functions, for example, brushes are available specifically for detangling hair or introducing tension when styling (such as those disclosed in other embodiments of WO2016/001658). Those skilled in the art of hair styling would tend to avoid such brushes for backcombing, since they are often unsuitable, for example because of the shape of the head, which in brushes that are not intended for backcombing are normally too wide to be effective.

The present invention seeks to provide an improved hairbrush specifically for backcombing and to overcome problems with other brushes in this field.

SUMMARY OF THE INVENTION

According to a first aspect of the present invention there is provided a backcombing brush, the brush comprising an array of bristles, each bristle extending from a base to a free end; characterised in that the array of bristles includes bristles of at least two lengths, bristles of a first length being shorter than bristles of a second length.

Thus, a brush is provided which is especially suited for backcombing hair. The provision of shorter (first) bristles (of a first length) amongst the longer (second) bristles (of a second length) leads to a greater density of bristles near the base of the brush, which creates a greater ability to ruck the hair, teasing strands towards the root to achieve body, whilst the longer bristles (of a second length) act as a guide, keeping the brush held within the section of hair that is being backcombed.

With each stroke, this arrangement drags back (i.e. rucks) less hair on the surface of a section of hair than conventional backcombing brushes with bunches of bristles, but reaches more deeply into each section (owing to the lack of bunches), to backcomb hair within the section, providing a more natural look and causing less damage. Of course, to increase the amount of hair that is backcombed, more backcombing actions can be repeated.

At least some or all of the bristles may comprise a first, relatively wide, portion which tapers from the base and a second, relatively narrow, portion which extends from the first portion to the free end.

According to a second aspect of the present invention there is provided a backcombing brush, the brush comprising an array of bristles, each bristle extending from a base to a free end; wherein the array of bristles includes bristles having a first, relatively wide, portion which tapers from the base and a second, relatively narrow, portion which extends from the first portion to the free end; the bristles being arranged in two or more spaced apart offset rows, characterised in that the centrelines of the rows are spaced apart such that no part, or substantially no part, of the bristles in one row extends between adjacent bristles in an adjacent row; and/or when viewed perpendicular to the rows, the width of the bristles, or the width of substantially all of the bristles is less than the space between adjacent bristles in an adjacent row, such that no space, or substantially no space between bristles in an adjacent row is occluded.

The bristles may comprise a small chamfer, or interface region, at their base, for example for aesthetic reasons. This may for example be less than a fifth, or a tenth of the total height of the bristle. It will be appreciated that a brush having such an overlap only in that region, for no technical effect, and no overlap in the remainder of the bristle-proper is to be considered to have no part, or substantially no part, of the bristles in one row extending between adjacent bristles in an adjacent row, and to occlude no space, or substantially no space between bristles in an adjacent row.

This arrangement, in which a gap is provided between bristles along their entire length (or substantially their entire length) is capable of reducing damage when backcombing, compared to a brush in which there is such an overlap.

The array of bristles may include bristles of at least two lengths, bristles of a first length being shorter than bristles of a second length.

The following optional features apply equally to the first and second aspects of the invention.

At least some or all of the bristles of a second length may comprise a first, relatively wide, portion which tapers from the base and a second, relatively narrow, portion which extends from the first portion to the free end.

This arrangement means that the longer bristles are more rigid near their base, which improves their interaction, along with the shorter bristles, to backcomb the hair, whereas the narrower portion extending to the free end is less rigid and therefore better able to smooth the hair after backcombing and guide the brush through a section of hair without getting stuck.

At least some of the bristles may not comprise a first, relatively wide, portion which tapers from the base and a second, relatively narrow, portion which extends from the first portion to the free end.

At least some or all of the bristles of a first length may not comprise a first, relatively wide, portion which tapers from the base and a second, relatively narrow, portion which extends from the first portion to the free end.

At least some or all of the bristles of a first length may be only slightly tapered, or substantially the same thickness along substantially their entire length, from the base to the free end.

Those skilled in the art will appreciate that the expression "relatively" above means relative to the other part described and is not used as a colloquial synonym to "quite".

The bristles may be arranged in rows.

The centre lines of the rows may be spaced apart such that no part of the bristles in one row extends between adjacent bristles in an adjacent row; and/or, when viewed perpendicular to the rows, the width of the first portion of the bristles in one row is, over part of their length, less than the space between adjacent bristles in an adjacent row such that the space between bristles in adjacent rows is not occluded, but rather a gap is provided between rows of bristles.

As set out above, the bristles of the second length may comprise a first, relatively wide, portion which tapers from the base and a second, relatively narrow, portion which extends from the first portion to the free end, whereas the bristles of a first length may be only slightly tapered, or substantially the same thickness along substantially their entire length, from the base to the free end.

Since the bristles of the first length are shorter than those of the second length, they do not need to be provided in separate sections in order to be sufficiently rigid. Indeed, being substantially the same thickness, or only slightly tapering from the base to the free end, means that they are substantially rigid along their entire length, which is desirable to ruck the hair.

The bristles may be arranged in two or more spaced apart, offset, rows. A row of bristles of the first length may be adjacent a row of bristles of the second length.

Some or all of the rows of bristles in the array may alternate between a row of the first length and a row of the second length.

The bristles of the first length may be no more than 15 mm long, preferably no more than 10 mm long, e.g. 7.4 mm (i.e. about 7 mm) or less long. The bristles of the first length may be at least 3 mm long, e.g. at least 5 mm long.

The bristles of the second length may be at least 18 mm long, preferably at least 25 mm long, e.g. 26 mm (i.e. about 26 mm) or more long. The bristles of the second length may be no more than 45 mm long, for example no more than 33 mm or no more than 28 mm long.

The bristles of the first length may be more than one sixth of the length of the bristles of the second length. The bristles of the first length may be less than half of the length of the bristles of the second length. The bristles of the first length may be between one fifth and one third of the length of the bristles of the second length, for example about one quarter of the length, e.g. 0.28 times as long.

The bristles of the second length may be at least 10 mm longer than the bristles of the first length, for example at least 15 mm longer than the bristles of the first length, such as 17.7 mm (i.e. about 18 mm), or more longer.

The brush may comprise a handle portion, on which no bristles are formed and a head portion. The handle portion may be less than 30 mm wide e.g. less than 20 mm wide, such, (i.e. about 16 mm) or less wide. The handle portion may reduce in width towards its free end, optionally to a point. The head may be less than 50 mm wide, for example less than 30 mm wide, e.g. less than 25 mm (such as about 23 mm) or less wide. This thin head and thin handle is best for backcombing, and the reduction in width of the handle towards the free end allows for it to be used to separate sections of hair.

A thumb-grip portion may be provided in the handle adjacent to the head. The thumb grip may be narrower than the head and the handle (i.e. narrower than the widest part of the head and the handle). This encourages a tight grip close to the head, which encourages accurate brushing.

The brush may have a longitudinal axis extending from the end of the handle portion to the end of the head portion. The array of bristles may be arranged such that the tips of the bristles in one or more rows in the longitudinal direction define a concave shape, or may be straight. The tips of the bristles perpendicular to the longitudinal direction may define a convex shape, or may be straight.

The first and/or second portion of the bristles having a first, relatively wide, portion which tapers from the base and a second, relatively narrow, portion may be flexible and may be resiliently flexible. The second portion may be more flexible than the first portion.

The first portion of the bristles having a first, relatively wide, portion which tapers from the base and a second, relatively narrow, portion may have a larger transverse cross-sectional area then the second portion.

A proportion, such as at least one quarter, and up to half, for example about two fifths, of the bristles in the array, or of the brush, may be provided with first and second portions. All of these bristles, may be of the same shape, i.e. substantially the same shape.

Another proportion, such as at least one quarter and up to three quarters, for example about three fifths of the bristles in the array or of the brush, may not be provided with first and second portions. All of these bristles, may be of the same shape, i.e. substantially the same shape.

All, substantially all, or a substantial proportion (such as at least half), of the bristles in the array, or of the brush, may be bristles of either the first length or bristles of the second length. All bristles of the first length may be the same length (i.e. substantially the same length, for example within 1 mm difference in length) and all the bristles of the second length may be the same length (i.e. substantially the same length, for example within 1 mm difference in length).

Alternatively, the bristles of the first length may not all be the same length, and the bristles of the second length may not all be the same length. For example, a substantial portion (such as at least half) of the bristles of the first length may be the same length and a substantial portion of the bristles of the second length may be the same length, but some bristles of the first and/or second length, e.g. less than 30%, less than 20%, or less than 10% may be of a different length. For example some of the bristles of the first and/or second length, e.g. less than 30%, less than 20%, or less than 10% may be shorter than the others.

The second portions of bristles of the second length having first and second portions may all be of the same length, regardless of the overall length of the bristles of the first length. Thus, for example, the head of the brush may be convex, with bristles nearest the middle shorter, to account for a bulging of the brush in that region, but the contour of the tips of the bristles may be straight and the second portions may be equally long. Likewise, all, substantially all, or a substantial portion (such as at least half) of the bristles of a first length may be uniformly (i.e. substantially uniformly) shorter than all, substantially all, or a substantial portion (such as at least half) of the bristles of a second length.

When viewed in the same direction, the width of the widest part of the first portion of the bristles having first and second portions may be at least twice or three times the width of any part of the second portion or the second portion at or near to its free end. When viewed in the same direction, the width of the widest part of the first portion of the bristles having first and second portions may be no more than four, or no more than three times the width of the bristle at any part of the second portion or at or near its free end. When viewed in the same direction, the width of the widest part of the first portion of the bristles having first and second portions may be four times (i.e. about three times) the width of any part of the second portion or the second portion at or near to its free end. For example, the width of the widest part of the first portion may be about 3.4 mm and the width of the second portion near to its free end may be about 0.8 mm.

The length of each of the bristles of a second length having first and second portions may be no greater than ten times its maximum width, or no greater than eight times its maximum width. The length of each of the bristles of a second length having first and second portions may be no less than five times, or no less than seven times its maximum width.

A longitudinal gap may be provided between adjacent bristles. The longitudinal gap between adjacent bristles at the height of the free ends of the first bristles may be no more than 1.5 mm, for example no more than 1 mm, e g about 0.8 mm or less. The longitudinal gap between adjacent bristles, at their bases may be no more than 1 mm, for example no more than 0.75 mm, such as 0.5 mm or less. This means that a fairly small gap is provided between the first bristles and bristles adjacent to the first bristles, so hair is easily rucked backwards in this region.

A lateral gap may be provided between adjacent bristles. The lateral gap between adjacent bristles at the height of the free ends of the first bristles may be no more than 2 mm, for example no more than 1.5 mm, e g about 1.2 mm or less. The lateral gap between adjacent bristles, at their bases may be no more than 1.5 mm, for example no more than 1 mm, such as 0.7 mm or less.

The longitudinal gap between centre points of at least some or all adjacent second bristles may be no less than 2 mm and/or no greater than 6 mm, for example no less than 3 mm and/or no greater than 5 mm, e g 4 mm (i.e. about 4 mm). The lateral gap between centre points of adjacent second bristles may be no less than 3 mm and/or no greater than 10 mm, for example no less than 7 mm, and/or no greater than 5 mm, for example 5.8 mm (i.e. about 6 mm). This means that a fairly large gap is provided between the second bristles, so that they do not ruck hair in this region, but rather serve to guide the brush through the hair during back-combing or to smooth the hair afterwards.

The various ranges and sizes mentioned above have been found to provide a satisfactory balance between the performance of the bristles of first and second lengths.

The width of the bristles having first and second portions may vary continuously or discontinuously between their base and free ends. Along part of its length, and preferably within the first portion of the bristles, the width of the bristles may taper at an angle greater than the angle of taper of a uniformly tapered bristle having the same length and variation in width. This allows there to be significantly more space between the second portion of the bristles in the array than the first portion, as compared to uniformly tapered bristles. This enables the two portions of the bristles to perform their different functions without being unduly long.

Two opposed edges of the first portion of those bristles comprising first and second portions may taper towards each other with a minimum average angle of at least 5 degrees between the opposed edges over the length of the first portion, and opposite sides of the second portion may taper towards each other with a maximum average angle of 3 degrees between opposed edges over the length of the second portion, for example no more than 2.5 degrees, e.g. about 2 degrees. Two opposed edges of the first portion may taper towards each other with a minimum average angle of at least 8 degrees or at least 10 degrees.

The angle between the opposed edges of the first portion may increase from the base of the first portion to the end of the first portion. The opposed edges of the first portion may be curved.

All opposed edges of the first portion may taper towards each other with a minimum average angle of at least 2 degrees between the opposed edges over the length of the first portion.

The degree of taper of the bristles may change abruptly at the interface between the first and second portions of the bristles.

These features provide for a bristle with a wider first portion which tapers relatively abruptly over its length or a small proportion of its length to a second portion which has only a gradual taper.

At least some of the bristles, or at least some or all of the bristles having first and second portions or at least some or all of the first portions of bristles having first and second portions may have a non-circular transverse cross-section over at least part or substantially all of their length. The cross-section may be elongate in shape and may be oval, i.e. substantially ovular.

At least some of the bristles, or at least some or all of the bristles having first and second portions or at least some or all of the second portions of bristles having first and second portions may have a circular transverse cross-section over at least part or substantially all of their length.

The first portion of at least some or all of the bristles having first and second portions may have a non-circular cross-section at its base which gradually transitions to a substantially circular cross-section at the point where it meets the second portion. The first portion of those bristles with first and second portions may terminate where the second portion begins. The bristles may consist only of the first and second portions. The bristles may comprise interface sections where they join the body of the brush. The bristles may consist only of the first portions, second portions and interface sections. The length of the interface sections may be less than 1 mm. The interface sections may be steeply tapered, e.g. by about 45 degrees.

Where at least part of the first portion has an oval cross-section, edges of the first portion lying on a long axis of its oval cross-section may approach each other in a curved path over the length of the first portion. Edges of the first portion lying on a short axis of its oval cross section may approach each other in a straight (i.e. substantially straight) path over the length of the first portion.

The second portion may have a circular (i.e. substantially circular) cross-section over all or substantially all of its length.

All opposed edges of the second portion may taper towards each other with a maximum average angle of 2 degrees between the opposed edges over the length of the second portion.

At least some of the bristles, or at least some or all of the bristles of a first length may have a circular transverse cross-section over at least part of or substantially all of their length, or may have a non-circular, e.g. elongate, such as ovular transverse cross-section over at least part of or substantially all of their length.

Where the bristles of a first length have a non-circular, e.g. ovular transverse cross-section over substantially all (or at least part) of their length, the long axis of the oval may be perpendicular to the long axis of bristles of a second length and/or parallel with the longitudinal axis of the brush.

This arrangement means that the short axis is bent as the bristles are pulled through the hair, so allows the bristle to be suitably wide to create suitable gaps between bristles with appropriate spacing, whilst not being too stiff.

The transverse cross section of at least some or all of the bristles, or at least some or all of the bristles of a first length, or at least some or all of the bristles of a second length may reduce, or be substantially constant along the entire length of the bristles from the base to the free end.

The reduction in transverse cross-sectional area away from the base leads to bristles which become ever more flexible away from the base; consequently, the first portions are relatively stiff, whilst the second portions are relatively flexible. Thus, the first portions act as a support allowing for the long bristles to reach deep into the hair. The stiff support means that the bristles bend much closer to the tips, this bending means that they do not get stuck in the hair. Provision of shorter bristles, as well as the longer bristles keeps the density of the longer bristles low, reducing the possibility of them catching and pulling hair and aids in grooming hair closer to the surface. The wide portion at the base also improves glossiness of hair at the surface.

The length of the second portion of bristles having first and second portions may be at least half of, or three quarters of, the length of the first portion. The length of the first portion may be at least half of, or three quarters of, the second portion. The length of the second portion of the bristles may be equal to (i.e. substantially equal to) the length of the first portion; for example, the length of the second portion may be about 12 mm and the length of the first portion may be about 14 mm.

Some or all bristles of the second length, comprising first and second portions, may comprise a second portion that is at least half the length of the length of the first bristles. The second portion may be at least as long as the first bristles, for example at least 1.5 times as long as the first bristles. The second portion may be no more than three times as long as the first bristles, for example no more than twice as long as the first bristles. For example, the second portion of bristles of a second length may be 14 mm (i.e. about 14 mm) and the bristles of a first length may be about 8 mm (e.g. 8.3 mm).

These dimensions/ratios lead to the second bristles being quite rigid up to the height at which they are adjacent to first bristles, which provides a good backcombing ability, and fairly rigid even above the height of the first bristles, but flexible higher still, in the region of the second portions. The spacing of the flexible part (used for smoothing) from the first bristles, encourages the smoothing action to be carried out without pushing the bristles too deeply into the hair such that the first bristles become involved in smoothing (and get caught in the tangles created by backcombing). It also assists in guiding the short bristles as they carry out the backcombing.

The bristles may all be spaced apart from one another (i.e. each arranged singly, as opposed to being arranged in bunches). This reduces the risk of hair binding to the brush.

Each row of bristles may be straight (i.e. substantially straight), or may be curved. The rows may be parallel (i.e. generally parallel). The bristles in each row, or at least a number of adjacent rows, may all be evenly spaced apart by the same distance (i.e. substantially the same distance).

Adjacent rows may be offset relative to each other so that the centre of each bristle in a row is aligned (i.e. substantially aligned) with the midpoint between bristles in an adjacent row.

There may be at least three, at least four or at least five rows of at least three, four or five bristles. There may be no more than ten, no more than 8, no more than 6, or no more than five rows of at least five bristles.

For example, there may be five rows of at least five bristles, such as five rows of at least ten bristles, such as two rows of at least ten (e.g. 20) second bristles and three rows of at least ten (e.g. nineteen) first bristles.

There may be no more than 500, no more than 200, no more than 150, or no more than 100 bristles.

There may be no more than 200, no more than 100, or no more than 50 (for example about 40) second bristles.

There may be no more than 200, no more than 100 or no more than 60 (for example 57) first bristles.

There may be at least 50, at least 75, or at least 90 bristles. For example, there may be about 100, e.g. 97 bristles.

This represents substantially fewer bristles than most prior art brushes and it is considered that the fewer bristles that are interacting with the hair, the lower the chance for damage during backcombing (which many people consider an inherently damaging process). Indeed, the provision of just 40 bristles of the second length, which interact with hair outside the backcombing region of the brush, is very few indeed; substantially less even than the brush proposed in WO2016/001658, which has four rows of eighteen bristles (i.e. a total of 72 bristles) all of which interact with hair both in the backcombing region (at their bases) and the smoothing region (towards their tips).

The bristles may form a rectangular (i.e. substantially rectangular) array of bristles having its long axis along the longitudinal axis of the brush.

The bristles may be moulded and may be moulded from a plastics material, particularly a resiliently flexible plastics material.

Bristles of a first length and bristles of a second length may have a similar width and/or shape when viewed in the direction perpendicular to the longitudinal axis. Bristles of a first length and bristles of a second length may have a dissimilar width and/or shape when viewed along the longitudinal axis. Bristles of a second length may have a width which is at least twice as wide as the bristles of a first length.

This arrangement, in which the bristles have a similar width in the direction perpendicular to the transverse direction means that the spacing between bristles and their thickness can be effectively the same as if all the bristles were short bristles, intended for backcombing. Having a wider width or different shape, e.g. the first portion with an elongate transverse cross section discussed above, when viewed along the longitudinal axis, allows the upper part of the longer (second) bristles to act as if they are on a notional base, flexing much higher up than would be the case if they were the same shape and width as the shorter bristles.

Bristles of the second length may comprise a first, relatively wide, portion which tapers from the base and a second, relatively narrow, portion which extends from the first portion to the free end, and said first portion has an elongate transverse cross section; the longitudinal axis of the transverse cross section being perpendicular to the longitudinal axis of the brush. This first portion forms a "notional base" that does not flex (at least not substantially, and at least in the direction through which the brush is brought through the hair. Consequently, the second portion acts like a flexible bristle set on a base higher up the brush.

Bristles of a second length may be rigid (i.e. substantially rigid) in the direction transverse to the longitudinal axis of the brush, from the base to at least the height of the free end of the bristles of a first length. This forms the "notional base" mentioned above.

Bristles of a first length may be flexible (i.e. substantially flexible) and at least a portion of the bristles of the length higher than the height of the free end of the bristles of a first length may also be flexible (i.e. substantially flexible).

The elongate array of bristles may be at least twice as long as it is wide, at least three times as long as it is wide, at least four times as long as it is wide, at least five or even at least six or more times as long as it is wide.

The width of the array (measured across its width from the outside of one bristle to the outside of the bristle on the opposite side) may be less than 30 mm, less than 25 mm, less than 20 mm, or less than 18 mm, such as about 15 mm (e.g. 13 mm).

The length of the array (measured from the outside of the outermost bristle at one end to the outside of the outermost bristle at the other end) may be at least 50 mm, at least 60 mm, or at least 70 mm, for example, about 75 mm, (e.g. 78 mm).

A third aspect of the invention extends to a method of backcombing hair with a brush according to the either the first aspect of the invention or the second aspect of the invention (optionally including any of the optional features) comprising sectioning the hair (optionally using the handle of the brush), and brushing at least one section of the hair towards the scalp.

The bristles of the first length and bristles of the second length may be used to brush hair towards the scalp.

The method may comprise sectioning and brushing a plurality of sections, for example at least 2, 3, 5, or 10 sections and may comprise brushing the or each section towards the scalp at least 2,3,5, or 10 times.

The method may comprise subsequently smoothing the backcombed hair and/or partially untangling backcombed hair using the bristles of the second length (only).

DETAILED DESCRIPTION OF THE INVENTION

In order that the invention may be more clearly understood embodiments thereof will now be described, by way of example only, with reference to the accompanying drawings, of which:

In the following, the terms front, back, top, bottom and like terms refer to the articles in the orientation in which they are illustrated, but should not be taken as otherwise limiting.

Figure 5:
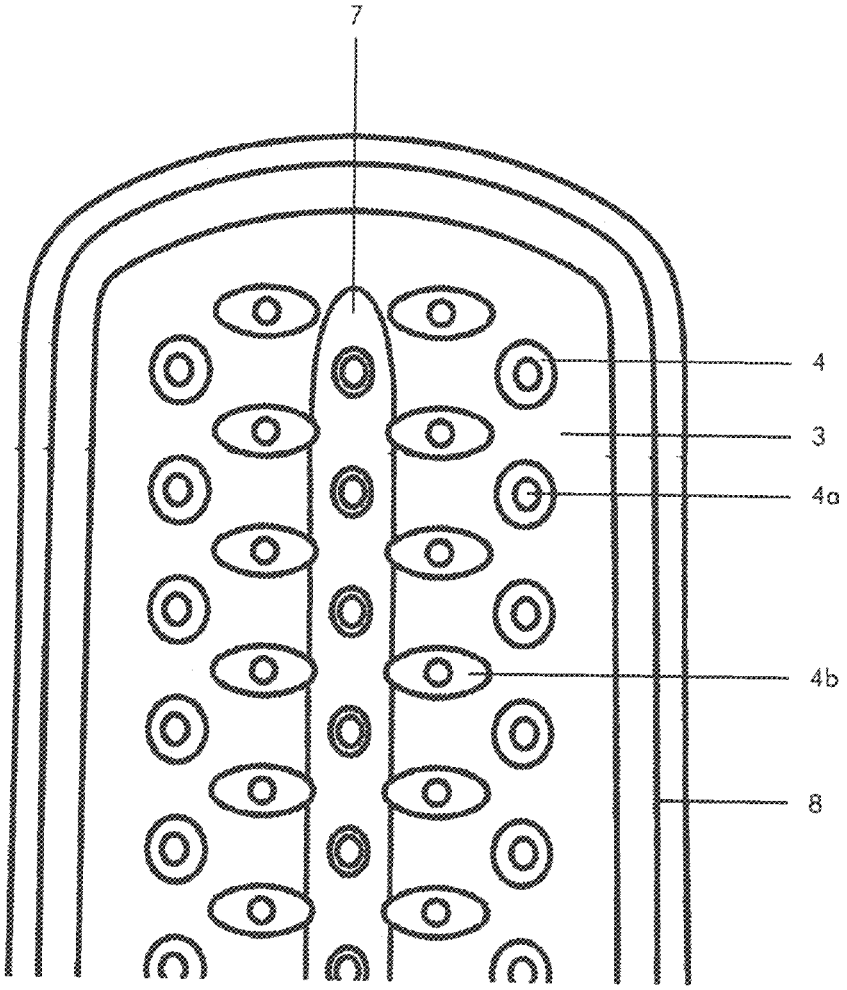
FIG. 5 is an enlarged plan view of part of an array of bristles of the hair bush of FIG. 1.
Figure 6:
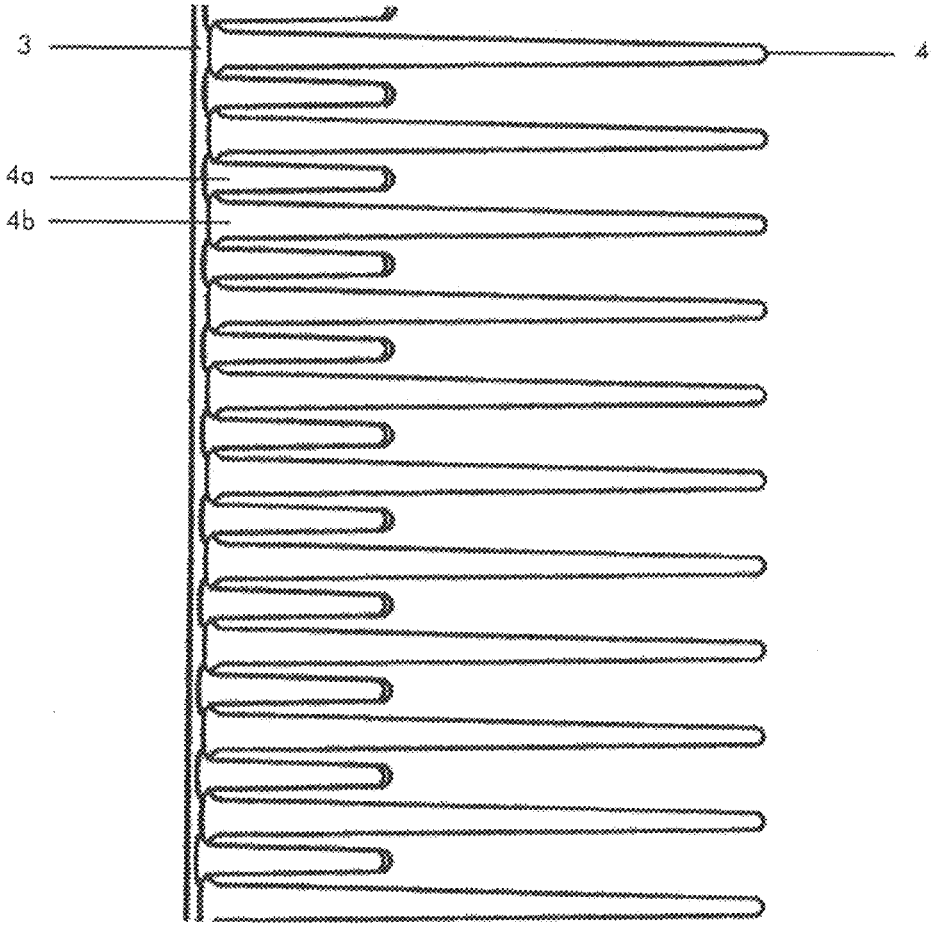
FIG. 6 is an enlarged side view of part of an array of bristles of the hair bush of FIG. 1
Figure 7:
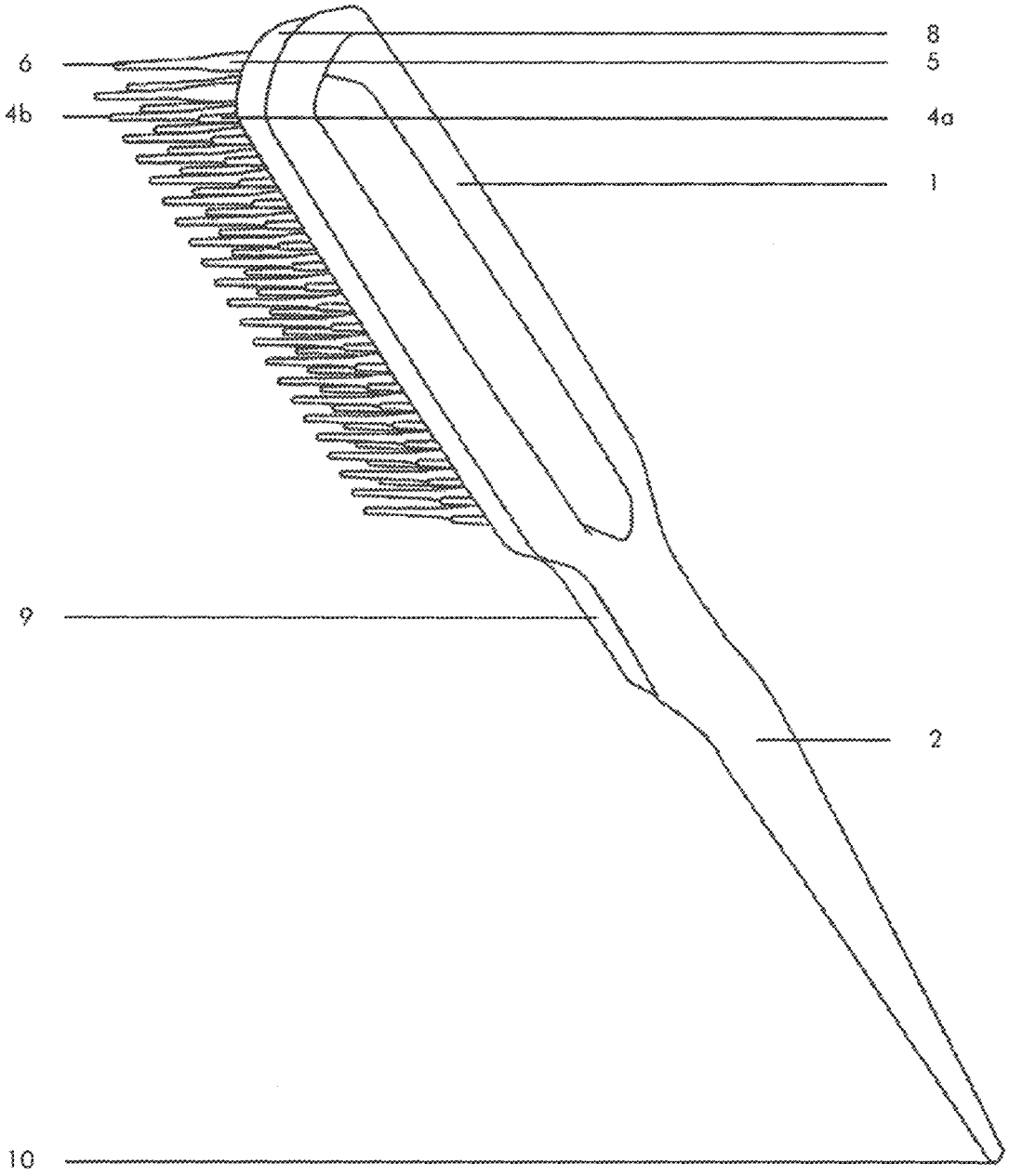
FIG. 7 is an underneath perspective view of the hair bush of FIG. 1.
Figure 8:
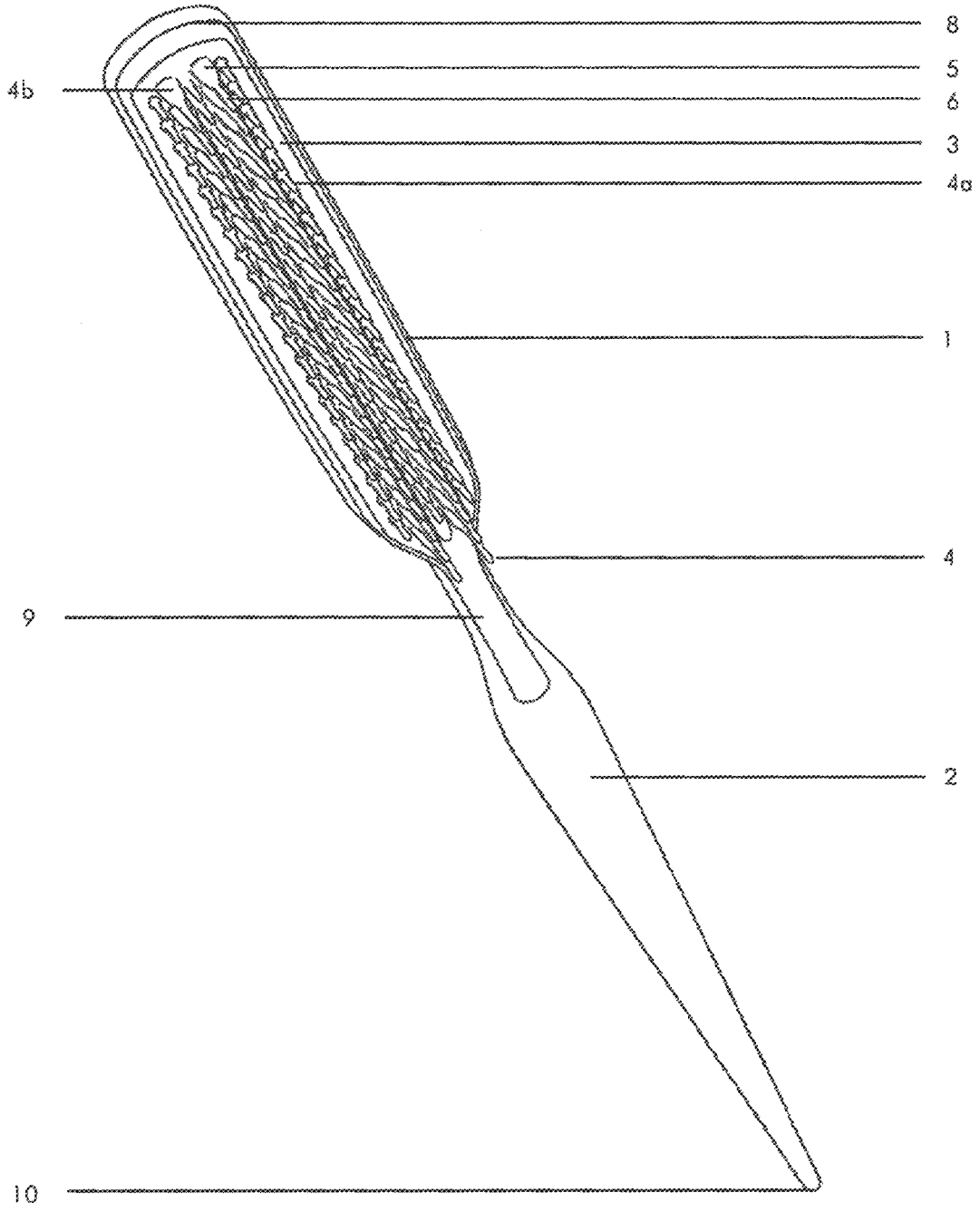
FIG. 8 is a top perspective view of the hair brush of FIG. 1.

Referring to the drawings, FIGS. 1 to 4, 7 and 8 show a hair brush, specifically a backcombing brush. FIGS. 5 and 6 show enlarged parts of the hair brush. The hair brush comprises a body, or head 1 of generally rectangular outline moulded in one piece with an elongate handle 2 which extends generally perpendicularly from the approximate mid-point of one of the ends of the body 1. The body 1 and handle 2 extend in generally the same plane.

The underside of the brush has a generally flat surface formed of a planar surface of the body 1 which merges into a planar surface of the handle 2. Two longitudinal grooves are provided in the underside of the body, which extend transversely to meet near the free end of the body 1, leaving a central ridge, which protrudes slightly and extends longitudinally along the middle of the underside of the body 1.

The opposite, upper side of the body 1 has a surface 3 which is generally flat and straight in the longitudinal direction and blends into a thumb-grip portion 9 of the handle 2, which extends from the approximate mid-point of one of the ends of the body and is narrower than the body, and narrower than the remainder of the handle 2 proximal thereto. Along the lateral plane (i.e. between the long sides of the head), the surface 3 of the upper side of the body 1 is generally slightly convex.

The outlines of the underside and the upper surface 3 of the brush are the same shape in the region of the body 1 and the thumb grip portion 9, but the outline of the underside has a greater area than the upper surface 3 in the region of the body 1 and the thumb portion 9. In this embodiment, the difference in area leads to each edge of the upper surface being located around 3 mm inward of the underside; with the width of the body at its widest (on the underside) being 24 mm and on the upper surface being 18 mm in width. The edges of the underside and the upper surface 3 are therefore joined by an inclined surface 8, which in this embodiment has a depth of about 15 mm. The inclined surface 8 is provided a formation to aid gripping, in the form of a step which runs around the inclined surface 8 and has the same outline as the outline of the upper surface 3 of the brush.

At the opposite end of the thumb-grip portion 9 to the body 1, the handle 2 sharply reduces in depth (towards the substantially flat underside) and flares outward, such that the main part of the handle is substantially thinner than the body 1; approximately 8 mm at its thickest, and after the flare, tapers gradually (in both thickness and width) to a point 10 of about 3 mm in diameter at its free end.

A groove 7 extends longitudinally along the centreline of the upper surface 3 of the body 1.

The body 1 comprises, or supports, moulded bristles 4 which project generally perpendicularly from the exposed upper surface 3. The bristles 4 extend parallel to one another, and generally perpendicular from the plane of the brush.

Each bristle 4 is spaced apart from each other bristle 4. All of the bristles 4 are moulded together in one piece, together with a base (which may form all or part of the upper surface 3 of the brush) from a resiliently flexible plastics material. Suitable materials are thermoplastic elastomers, such as copolyesters and aliphatic polyamides (nylons) and, in particular, the copolyester sold under the trade mark Hytrel by E. I. du Pont de Nemours and Company. Grades of Hytrel with hardness from 45 to 82 Shore D are particularly suitable, especially grades in the range of 63 to 72 Shore D, such as Hytrel 6356 and Hytrel 7246.

As best seen in FIGS. 2-8, two types of bristle 4 are provided; first bristles 4*a* have a first length which is much shorter than that of second bristles 4*b* of a second length.

Each first bristle 4*a* has a base with a slightly ovular cross section, having a long axis that is very slightly longer than its perpendicular short axis and tapering slightly to its free end, whilst maintaining a slightly ovular cross section. The long axis of each first bristle is parallel with the longitudinal axis of the brush. On the other hand, each second bristle 4*b* has a base with a distinctly oval cross-section, having a long axis and a much shorter perpendicular short axis. As the second bristle 4*b* extends away from the base it tapers. Over a first portion 5 of the length of the second bristle 4*b* the second bristle 4*b* tapers such that its cross-sectional shape changes from oval to substantially circular. The long axis of each second bristle 4*b* is transverse to the longitudinal axis of the brush.

Figure 1:
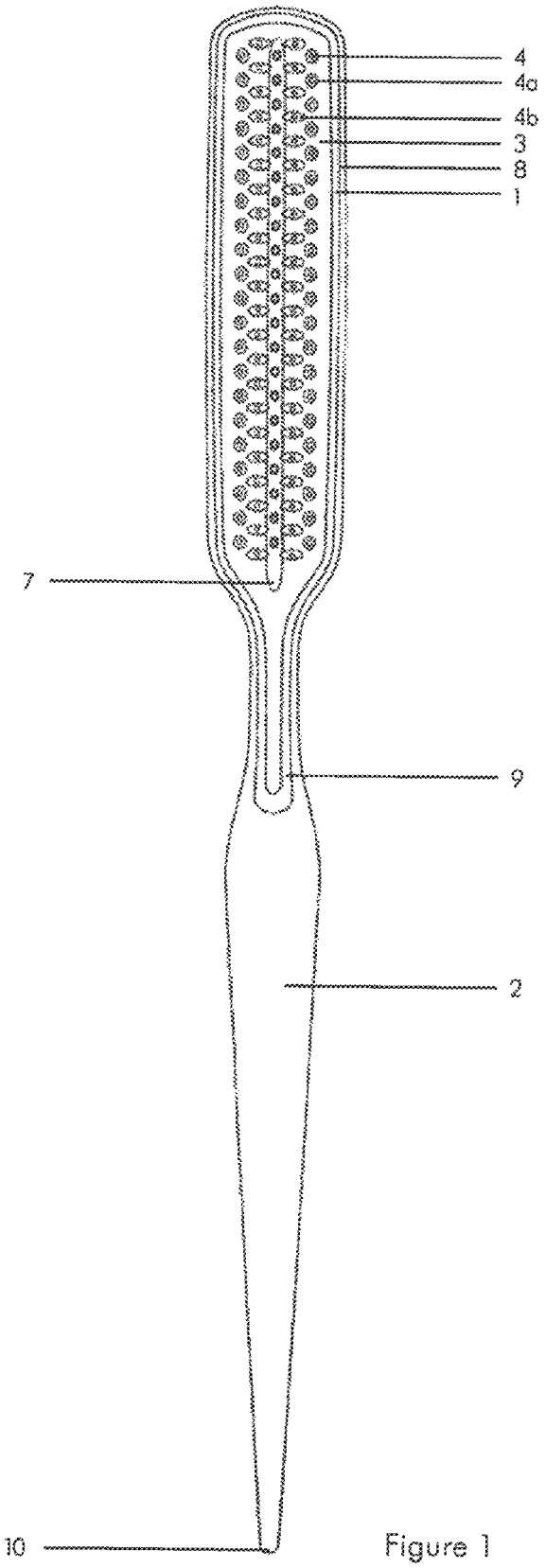
FIG. 1 is a plan view of a backcombing hair brush.
Figure 2:
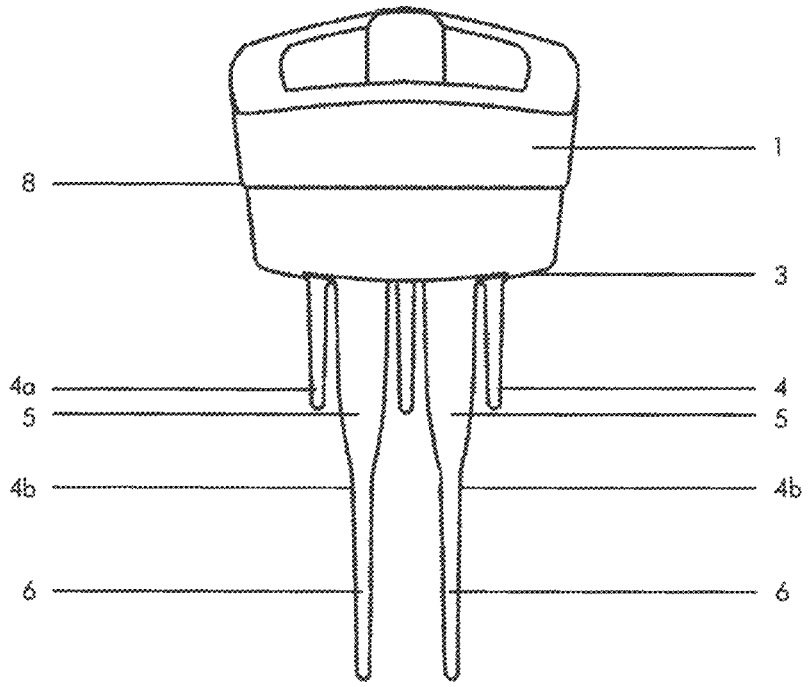
FIG. 2 is an end view the hair brush of FIG. 1.
Figure 3:
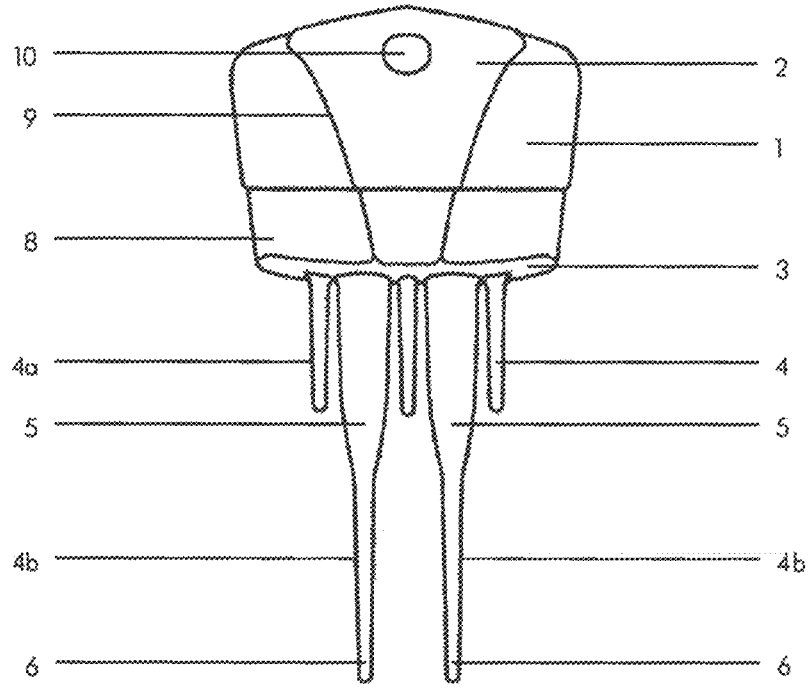
FIG. 3 is another end view of the hair brush of FIG. 1.

As can be seen best in FIGS. 2 and 3, which are end views along the longitudinal axis of the brush, perpendicular to the long axis of the bristles, the edges of the second bristles 4*b* through which the long axis extends approach each other at an increasingly steep angle as each bristle 4*b* extends away from the base. The opposite edges approach each other in a curved path.

Figure 4:
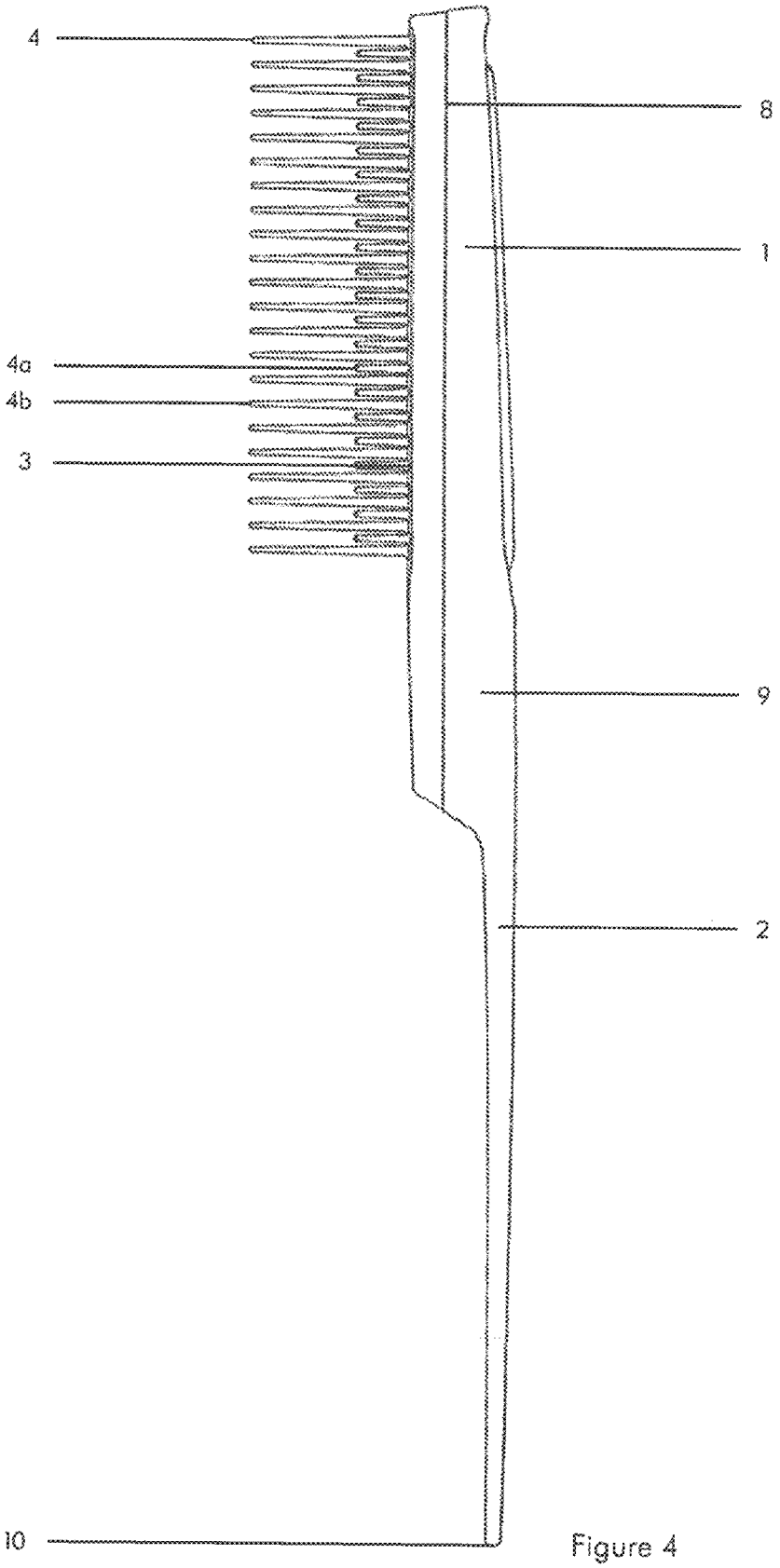
FIG. 4 is a side view of the hair brush of FIG. 1.

As seen best in FIGS. 4 and 6, the edges of the second bristle 4*b* through which the short axis extends approach each other at a substantially constant angle, and the edges of these second bristles 4*b* are therefore substantially straight.

As can be best seen from FIGS. 4 to 6, the edges of the first bristles 4*a* approach each other at a substantially constant angle, and are substantially straight, with a very slightly ovular (almost circular) transverse cross section throughout.

In consequence, when viewed perpendicular to the long axis of the brush, the shape and width of the first bristles 4*a* and second bristles 4*b* is similar, whilst when viewed along the longitudinal axis of the brush, their shape and width is dissimilar.

At the end of the first portion 5 of each of the second bristles 4*b* its cross-section is substantially circular. At this point a second portion 6 of the second bristle 4*b* begins. Over the second portion 6 of the second bristle 4*b* the cross-section of the bristle 4 remains substantially circular and the second bristle 4*b* tapers towards a free end, with a domed surface. The degree of taper of the second bristle 4*b* over the second portion 6 of the bristle is less than over the first portion 5, and especially compared to the degree of taper in the first portion 5 immediately adjacent to the second portion 6. There is therefore a discontinuity in the shape of the surface of the second bristle 4*b* at the junction between the first and second portions.

The degree of taper of the second portion 6 of the second bristle 4*b* is in effect the minimum consistent with being able to reliably remove the second bristle 4*b* from a mould tool. So far as the function of the second portion 6 of the second bristle 4*b* is concerned it could have a substantially constant diameter. The same is true of the first bristles 4*a*.

Most of the first bristles are of the same length as most of the other first bristles and have the dimensions discussed below. Most of the second bristles 4*b* have the same length as the other second bristles and have the dimensions discussed below. It will be appreciated that minor differences in height between the bristles may be made for aesthetic reasons, without impacting function.

In the illustrated embodiment each of the first bristles 4*a* extends about 8.3 mm from the base to the tip.

In the illustrated embodiment the first portion 5 of the second bristles 4*b* extends about 14 mm from the base, and the second portion 6 of the second bristles 4*b* extends about a further 12 mm from the end of the first portion 5 to the end of the bristle 4*b*. The domed end of the bristles 4 has a radius of curvature of about 0.4 mm.

The very bottom of each bristle is an interface section, or platform 9, of minimal height (e.g. typically less than 1 mm), where the upper surface 3 and the bristles 4 meet, and which sharply tapers inward from the upper surface. Above this interface section, the widest part of each first bristle 4*a*, measured at its base, has a width of about 1.3 mm along its long axis and a width of about 1.11 mm along its short axis. The sides of each first bristle 4*a* at the long axis approach each other at an angle of about 2.9 degrees, whilst the closest opposing sides approach each other at an angle of 2.4 degrees.

At the at the free end of each first bristle 4*a*, not including the domed end, each first bristle 4*a* has a slightly ovular cross-section with a diameter of about 0.82 mm at the short axis and about 1.0 mm at the longer axis.

The widest part of the first portion 5 of each second bristle 4*b*, measured above the interface section, along the long axis of its oval cross-section, has a width of about 3.4 mm. The narrowest part of the base of each second bristle 4*b*, above the interface section, measured along the short axis of its oval cross-section, has a depth of about 1.65 mm. The sides of each second bristle 4*b* along its short axis approach each other at an angle of about 2 degrees. The sides of each second bristle 4*b* along its long axis approach each other with a gradually increasing angle, forming a smooth curve. The average angle of taper between the two sides of each first portion of each second bristle 4*b* along its long axis is 9.7, i.e. approximately 10 degrees, that is to say the angle of taper that would be required if the sides were straight rather than tapered.

At the end of the first portion 5*b* of each second bristle 4*b* it has a substantially circular cross-section with a diameter of about 1.2 mm.

The sides of each second bristle 4*b* approach each other over the second portion 6*b* of its length with an angle of about 2 degrees, resulting in a diameter of about 0.8 mm at the free end of each second bristle 4*b*, not including the domed end.

Other dimensions are possible, as discussed elsewhere.

The array of bristles 4 is generally rectangular in shape, with a long axis parallel with the longitudinal axis of the brush, and is intended to be moved through hair in a direction generally perpendicular to the long sides of the rectangle.

Each bristle 4 in the array forms a part of a "long row" of bristles 4 (i.e. a row that extends along the length of the body 1) and a "short row" of bristles 4 which extends transversely to the long row (across the width of the body 1).

Each of the long rows are straight (but could be slightly curved), substantially parallel and substantially evenly spaced apart. In each long row the bristles 4 are substantially evenly spaced apart, with the long axes of the oval cross-section of the first bristles 4*a* all lying substantially along the same straight line, and the long axes of the first portions 5 of the second bristles 4*b* perpendicular to the straight line. The bristles 4 are spaced apart by the same amount in each long row and adjacent long rows are off-set relative to one another so that the centre of the cross-section of the bristles 4 in one row lies mid-way between adjacent bristles 4 in the adjacent row. In this embodiment, the distance between centre points of adjacent bristles in each long row is 4 mm.

Each of the short rows are substantially straight and substantially parallel. In each short row the bristles 4 are substantially evenly spaced apart, with the short axes of the oval cross-section of the first bristles 4*a* lying along substantially the same line and the long axes of the first portions 5 of the second bristles 4*b* lying along substantially the same line. The bristles 4 are spaced apart by the same amount in each short row and the centre-lines of each short row are spaced apart sufficiently that (with the exception of the interface regions), no part of any bristle 4 in any row extends between two adjacent bristles 4 in the or each adjacent short row. That can be seen best in FIGS. 2, 3 and 6. In this embodiment, the distance between centre points of adjacent bristles in each short row is 5.8 mm.

Consequently the distance between centre-lines of adjacent short rows of bristles is (4 mm±2=) 2 mm and the distance between centre-lines of adjacent long rows of bristles is (5.8 mm±2=) 2.9 mm.

In the illustrated embodiment the array comprises five long rows; three long rows of short bristles 4*a*, one arranged along the groove 7 and two rows parallel and outboard of that middle row, with two long rows of long bristles 4*b* arranged either side of the middle row inward of the outboard rows. Each long row of (short) first bristles 4*a* has nineteen bristles 4*a*, whilst each long row of (long) second bristles 4*b* has twenty bristles.

The short rows are composed of either just two longer second bristles 4*b*, or three shorter first bristles 4*a*.

Of course, the number of rows and number of bristles in each row can be varied as desired and appropriate. Other shapes of array are also possible.

The centre lines of the long rows are spaced apart by 2.9 mm, and a longitudinal gap of about 0.7 mm is provided between the base of each first portion 5 of a second bristle 4*b* and the adjacent first bristle 4*a*; at the top of the first bristle 4*a*, the gap is about 1.1 mm. There is no longitudinal gap at the interface portion, but as set out above, this part is merely for aesthetic purposes and is so short as to have no technical effect, not contributing to the brushing. Consequently, no part of the first portion 5 of bristles in one row extends between adjacent bristles 4 in an adjacent row.

The provision of five long rows having centrelines spaced apart by 2.9 mm means that the bristles extend over a width of about 12-13 mm, whilst a total of 39 short rows of bristles having centrelines spaced apart by 2 mm means that the bristles extend over a length of about 80 mm as 39×2=78 mm.

Although the bristles 4 are moulded in a single piece from the same material, owing to their different cross-section and shape, the first portions 5 are significantly stiffer than the second portions 6. In practice, in use, the first portions 5 are quite inflexible, whereas the second portions are highly flexible. The second portions 5 can be easily bent completely back on themselves (such that the tip points back towards the upper surface, whilst the first portions 6 remain completely perpendicular to the upper surface 3). On the other hand, a relatively high level of force is required to bend the first portions 6 even to 90 degrees, and it is very difficult to bend the first portions 6 even to 90 degrees by hand when bending in line with their long axis.

Not taking into account the interface portions, the width of the base of the bristles 4, along the length of a long row of bristles 4, is less than the space between adjacent bristles 4 in the row, so no bristle 4 occludes the gap between the base of adjacent bristles 4 in adjacent rows 4 when viewed in a direction perpendicular to that of the long rows of bristles 4.

The first bristles 4*a* and the second bristles 4*b* are arranged in the array such that each short row of first (shorter) bristles 4*a* is located between two short rows of second (longer) bristles 4*b*. Each short row of second (longer) bristles 4*b* is located between two short rows of shorter bristles 4*a*, except those at each end.

The contrary is true of the long rows of bristles 4, in that each long row of longer bristles 4*a* is located between two long rows of shorter bristles 4*a*, whereas only the middle row of shorter bristles 4*a* is located between two rows of longer bristles 4*b*. Consequently, the distance between centrelines of rows of bristles 4 of the same length is approximately twice the distance between centrelines of adjacent rows of bristles 4.

Accordingly, the density of each type of bristle 4 is less than the total density of bristles 4. Only approximately two fifths of the bristles (i.e. 40 out of 97) are second (long) bristles 4*b*, and approximately three fifths of the bristles (57 out of 97) are first bristles 4*a* of a shorter length.

As set out above, this brush is a backcombing brush, particularly suited to and intended for backcombing hair. In use, a user takes a section of hair, conveniently by introducing the point of the handle along the scalp parallel to a centre parting and lifting up a section of hair of say about 1-2 cm in width at the base and 5-10 cm along the scalp. Optionally, that section of hair may then be brushed away from the scalp in preparation for backcombing. The user holds the brush by the handle 2, pinching the thumb grip 9 and then introduces the bristles deep into the section, so that the shorter (first) bristles 4*a* extend well into the section; the brush is then worked up and down, with the longer bristles 4*b* serving as a guide as the hair is caught in the gaps between the first bristles 4*a* and the first portions 5 of the longer bristles 4*b* and back-combed, so as to ruck up at the scalp. The fact that the array of bristles 4 is thin (only about 12 mm wide) as is the body 1 means that the backcombing brush can be worked along the majority of the length of the hair, picking up hair from near the tips or the middle, and brushing it down to the scalp to form tangles/knots. Of course other brushes which are not intended for backcombing tend to be wide and therefore are unsuited to this job, unable to pick up hair towards the tips or the middle and pull it right down to the base.

This process is repeated, with the user sectioning adjacent sections from the hair, optionally using the handle to carry out sectioning (holding the thumb grip) then brushing up and down the section to backcomb the hair such that some of it nicks up, tangling/knotting at the base. Once satisfactory backcombing of the area required has been conducted, the user can smooth and style the surface of the hair using the second portions 6 of the second bristles 4*b*, which are widely spaced from each other and therefore do not grab the hair.

Owing to the much greater length of the second bristles 4*b*, more than 17 mm longer than the first bristles 4*a*, a further action, can also be carried out, with the second bristles 4*b* being introduced deep into the backcombed hair to partially untangle the backcombed region, in order to reduce volume in certain areas if necessary and further improve the style. As with the surface styling, the wide spacing of the bristles, and their flexibility in the region that extends into the body of the hair, means that this action can be carried out without grabbing and tugging the hair.

Once pressure of the brush onto hair is released, the shape of the first portion 5 of the bristles allows the hair to move easily off the bristles, into regions where there is more space between the bristles 4. This reduces the risk of hair binding onto the brush. The backcombing and subsequent styling process is especially enhanced by the large gaps between the second bristles 4*b* near their tips, which results from the inclusion of long and short bristles.

The above embodiment is described by way of example only. Many variations are possible without departing from the scope of the invention as defined in the appended claims.

The invention claimed is:

1. A backcombing brush, the brush being elongate and having a longitudinal axis, the brush comprising an elongate array of bristles, the array having a longitudinal axis substantially parallel with the longitudinal axis of the brush and each bristle extending from a base to a free end;

wherein the array of bristles includes bristles of at least two lengths, bristles of a first length being less than half of the length of the bristles of a second length;

wherein at least some or all of the bristles of a second length comprise a first, relatively wide, portion which tapers from the base and a second, relatively narrow, portion which extends from the first portion to the free end; and wherein at least some or all of the bristles of a first length do not comprise a first, relatively wide, portion which tapers from the base and a second, relatively narrow, portion which extends from the first portion to the free end, further wherein bristles of a first length and bristles of a second length have a similar width and/or shape when viewed in the direction perpendicular to the longitudinal axis and wherein bristles of a first length and bristles of a second length have a dissimilar width and/or shape when viewed along the longitudinal axis and wherein the bristles of a second length have a width which is at least twice as wide as the bristles of a first length.

2. A backcombing brush according to claim 1, wherein the bristles are arranged in two or more spaced apart offset rows and the centerlines of the rows are spaced apart such that no part, or substantially no part, of the bristles in one row extends between adjacent bristles in an adjacent row; and/or when viewed perpendicular to the rows, the width of the bristles, or the width of substantially all of the bristles is less than the space between adjacent bristles in an adjacent row, such that no space, or substantially no space between bristles in an adjacent row is occluded.

3. A backcombing brush according to claim 1 wherein at least some or all of the bristles of a first length are only slightly tapered, or substantially the same thickness along substantially their entire length, from the base to the free end.

4. A backcombing brush according to claim 1 wherein the bristles are arranged in two or more spaced apart, offset, rows and a row of bristles of the first length is adjacent a row of bristles of the second length.

5. A backcombing brush according to claim 4 wherein some or all of the rows of bristles in the array alternate between a row of the first length and a row of the second length.

6. A backcombing brush according to claim 1 wherein the bristles of the first length are no more than 10 mm long and the bristles of the second length are at least 25 mm long.

7. A backcombing brush according to claim 1 wherein a longitudinal gap is provided between adjacent bristles and the longitudinal gap between adjacent bristles at the height of the free ends of the first bristles is no more than 1 mm and/or, the longitudinal gap between adjacent bristles, at their bases is no more than 0.75 mm.

8. A backcombing brush according to claim 1 wherein a longitudinal gap is provided between adjacent bristles, and the longitudinal gap between center points of at least some or all adjacent second bristles is no less than 3 mm and/or no greater than 5 mm and/or wherein the lateral gap between center points of adjacent second bristles is no less than 7 mm, and/or no greater than 5 mm.

9. A backcombing brush according to claim 1 wherein the width of the bristles having first and second portions varies discontinuously between their base and free ends and within the first portion of the bristles, the width of the bristles tapers at an angle greater than the angle of taper of a uniformly tapered bristle having the same length and variation in width.

10. A backcombing brush according to claim 9 wherein the degree of taper of the bristles with first and second portions changes abruptly at the interface between the first and second portions of the bristles.

11. A backcombing brush according to claim 1 wherein at least some or all of the first portions of bristles having first and second portions, have a non-circular transverse cross-section over at least part or substantially all of their length;

wherein the non-circular cross-section is oval; and wherein the bristles of a first length have an ovular transverse cross-section over substantially all of their length, and the long axis of the oval is parallel with the longitudinal axis of the brush.

12. A backcombing brush according to claim 1 wherein the length of the second portion of bristles having first and second portions is at least three quarters of the length of the first portion and/or the length of the first portion is at least three quarters of the length of the second portion; and wherein some or all bristles of the second length, comprise first and second portions wherein a second portion is at least 1.5 times as long as the first bristles.

13. A backcombing brush according to claim 1 wherein there are at least three, and no more than 8 rows of at least five bristles.

14. A backcombing brush according to claim 1 wherein there are no more than 100 second bristles and/or no more than 100 first bristles and wherein the bristles form a rectangular array of bristles having its long axis along a longitudinal axis of the brush.

15. A backcombing brush according to claim 1 wherein bristles of a second length are substantially rigid in the direction transverse to the longitudinal axis of the brush, from the base to at least the height of the free end of the bristles of a first length.

16. A backcombing brush according to claim 15 wherein the bristles of a first length are substantially flexible and at least a portion of the second bristles of the length higher than the height of the free end of the bristles of a first length is substantially flexible.

17. A backcombing brush according to claim 1 wherein the elongate array of bristles is at least four times as long as it is wide; wherein the width of the array is less than 20 mm; and wherein the length of the array is at least 60 mm.

18. A method of backcombing hair with a brush according to claim 1 comprising sectioning the hair, and brushing at least one section of the hair towards the scalp using the brush using the bristles of the first length and bristles of the second length and subsequently smoothing the backcombed hair and/or partially untangling backcombed hair using the bristles of the second length.

19. A backcombing brush, the brush being elongate and having a longitudinal axis, the brush comprising an elongate array of bristles, the array having a longitudinal axis substantially parallel with the longitudinal axis of the brush and each bristle extending from a base to a free end;

wherein the array of bristles includes bristles of at least two lengths, bristles of a first length being less than half of the length of the bristles of a second length;

wherein at least some or all of the bristles of a second length comprise a first, relatively wide, portion which tapers from the base and a second, relatively narrow, portion which extends from the first portion to the free end; and wherein at least some or all of the bristles of a first length do not comprise a first, relatively wide, portion which tapers from the base and a second, relatively narrow, portion which extends from the first portion to the free end further wherein a longitudinal gap is provided between adjacent bristles and the longitudinal gap between adjacent bristles at the height of the free ends of the first bristles is no more than 1 mm and/or, the longitudinal gap between adjacent bristles, at their bases is no more than 0.75 mm.

20. A backcombing brush, the brush being elongate and having a longitudinal axis, the brush comprising an elongate array of bristles, the array having a longitudinal axis substantially parallel with the longitudinal axis of the brush and each bristle extending from a base to a free end;

wherein the array of bristles includes bristles of at least two lengths, bristles of a first length being less than half of the length of the bristles of a second length;

wherein at least some or all of the bristles of a second length comprise a first, relatively wide, portion which tapers from the base and a second, relatively narrow, portion which extends from the first portion to the free end; and wherein at least some or all of the bristles of a first length do not comprise a first, relatively wide, portion which tapers from the base and a second, relatively narrow, portion which extends from the first portion to the free end, further wherein the length of the second portion of bristles having first and second portions is at least three quarters of the length of the first portion and/or the length of the first portion is at least three quarters of the length of the second portion; and wherein some or all bristles of the second length, comprise first and second portions wherein a second portion is at least 1.5 times as long as the first bristles.

21. A backcombing brush, the brush being elongate and having a longitudinal axis, the brush comprising an elongate array of bristles, the array having a longitudinal axis substantially parallel with the longitudinal axis of the brush and each bristle extending from a base to a free end;

wherein the array of bristles includes bristles of at least two lengths, bristles of a first length being less than half of the length of the bristles of a second length;

wherein at least some or all of the bristles of a second length comprise a first, relatively wide, portion which tapers from the base and a second, relatively narrow, portion which extends from the first portion to the free end; and wherein at least some or all of the bristles of a first length do not comprise a first, relatively wide, portion which tapers from the base and a second, relatively narrow, portion which extends from the first portion to the free end, further, wherein the bristles of the first length are no more than 10 mm long and the bristles of the second length are at least 25 mm long.

22. A backcombing brush, the brush being elongate and having a longitudinal axis, the brush comprising an elongate array of bristles, the array having a longitudinal axis substantially parallel with the longitudinal axis of the brush and each bristle extending from a base to a free end;

wherein the array of bristles includes bristles of at least two lengths, bristles of a first length being less than half of the length of the bristles of a second length;

wherein at least some or all of the bristles of a second length comprise a first, relatively wide, portion which tapers from the base and a second, relatively narrow, portion which extends from the first portion to the free end; and wherein at least some or all of the bristles of a first length do not comprise a first, relatively wide, portion which tapers from the base and a second, relatively narrow, portion which extends from the first portion to the free end, further wherein the elongate array of bristles is at least four times as long as it is wide; wherein the width of the array is less than 20 mm; and wherein the length of the array is at least 60 mm.

23. A backcombing brush, the brush being elongate and having a longitudinal axis, the brush comprising an elongate array of bristles, the array having a longitudinal axis substantially parallel with the longitudinal axis of the brush and each bristle extending from a base to a free end;

wherein the array of bristles includes bristles of at least two lengths, bristles of a first length being less than half of the length of the bristles of a second length;

wherein at least some or all of the bristles of a second length comprise a first, relatively wide, portion which tapers from the base and a second, relatively narrow, portion which extends from the first portion to the free end; and wherein at least some or all of the bristles of a first length do not comprise a first, relatively wide, portion which tapers from the base and a second, relatively narrow, portion which extends from the first portion to the free end, further wherein a longitudinal gap is provided between adjacent bristles, and the longitudinal gap between center points of at least some or all adjacent second bristles is no less than 3 mm and/or no greater than 5 mm and/or wherein the lateral gap between center points of adjacent second bristles is no less than 7 mm, and/or no greater than 5 mm.

* * * * *